US011002277B2

(12) United States Patent
Jambigi et al.

(10) Patent No.: US 11,002,277 B2
(45) Date of Patent: May 11, 2021

(54) COMPRESSOR SYSTEM AND SYSTEM FOR MAINTAINING A DESIRED OIL LEVEL

(71) Applicant: INGERSOLL-RAND INDUSTRIAL U.S., INC., Davidson, NC (US)

(72) Inventors: Mallikarjun Jayadevappa Jambigi, Bangalore (IN); Sunil Jayalakshmamma Munisubbaiah, Bangalore (IN)

(73) Assignee: INGERSOLL-RAND INDUSTRIAL U.S. INC., Davidson, NC (US)

( * ) Notice: Subject to any disclaimer, the term of this patent is extended or adjusted under 35 U.S.C. 154(b) by 370 days.

(21) Appl. No.: 15/936,953

(22) Filed: Mar. 27, 2018

(65) Prior Publication Data

US 2019/0301465 A1 Oct. 3, 2019

(51) Int. Cl.

| | |
|---|---|
| ***F04C 29/02*** | (2006.01) |
| ***F04C 29/12*** | (2006.01) |
| *F04C 18/16* | (2006.01) |

(52) U.S. Cl.

CPC ..... *F04C 29/021* (2013.01); *F04C 29/026* (2013.01); *F04C 29/124* (2013.01); *F04C 18/16* (2013.01); *F04C 2270/18* (2013.01); *F04C 2270/24* (2013.01); *F04C 2270/585* (2013.01)

(58) Field of Classification Search

CPC .. F04C 29/026; F04C 29/124; F04C 2270/24; F04C 2270/585

USPC ..... 184/6.11

See application file for complete search history.

(56) References Cited

U.S. PATENT DOCUMENTS

| | | | | |
|---|---|---|---|---|
| 3,052,317 | A * | 9/1962 | Leach | F16K 5/22 184/6.1 |
| 3,500,962 | A * | 3/1970 | Kocher | F04B 41/06 184/103.1 |
| 3,724,231 | A | 4/1973 | Grant | |
| 3,876,037 | A * | 4/1975 | Rath, Jr. | F01M 11/061 184/6.4 |
| 4,012,012 | A * | 3/1977 | Ligler | B64D 33/00 244/1 R |
| 4,511,016 | A * | 4/1985 | Doell | F16N 7/40 184/6.11 |

(Continued)

FOREIGN PATENT DOCUMENTS

| | | |
|---|---|---|
| GB | 799689 | 8/1958 |
| JP | 05141371 A | 6/1993 |

*Primary Examiner* — Michael R Mansen
*Assistant Examiner* — Mark K Buse
(74) *Attorney, Agent, or Firm* — Kevin E. West; Advent, LLP

(57) ABSTRACT

A compressor system includes: a compressor having a suction side and a discharge side, wherein the compressor is operative to compress a gas using oil, wherein the suction side operates at a suction pressure and is operative to receive a the gas and the oil into the compressor; and wherein the discharge side is operative to discharge the compressed gas and the oil; a gas/oil separator tank operative to store oil separated from the compressed gas for subsequent use by the compressor; a supplemental oil reservoir in fluid communication with the suction side; and a valve operative to, when opened, expose the supplemental oil reservoir to the suction pressure of the suction side of the compressor, and draw oil from the supplemental oil reservoir by suction into the suction side of the compressor.

18 Claims, 1 Drawing Sheet

(56) References Cited

U.S. PATENT DOCUMENTS

| | | | | | |
|---|---|---|---|---|---|
| 4,556,024 | A * | 12/1985 | King | F01M 1/10 | 123/142.5 R |
| 4,869,346 | A * | 9/1989 | Nelson | F01M 11/0458 | 184/1.5 |
| 5,238,085 | A * | 8/1993 | Engelmann | F01M 11/04 | 123/196 S |
| 5,390,762 | A * | 2/1995 | Nelson | F01M 11/0458 | 123/196 S |
| 5,901,559 | A * | 5/1999 | Westermeyer | G01F 23/74 | 417/12 |
| 6,125,642 | A * | 10/2000 | Seener | F04C 18/0215 | 184/103.1 |
| 7,240,692 | B2 * | 7/2007 | Parkkinen | F04B 41/00 | 137/563 |
| 2012/0285559 | A1 * | 11/2012 | Harper | F04B 39/04 | 137/544 |
| 2015/0343365 | A1 * | 12/2015 | Borkowski | B01D 45/08 | 96/397 |

* cited by examiner

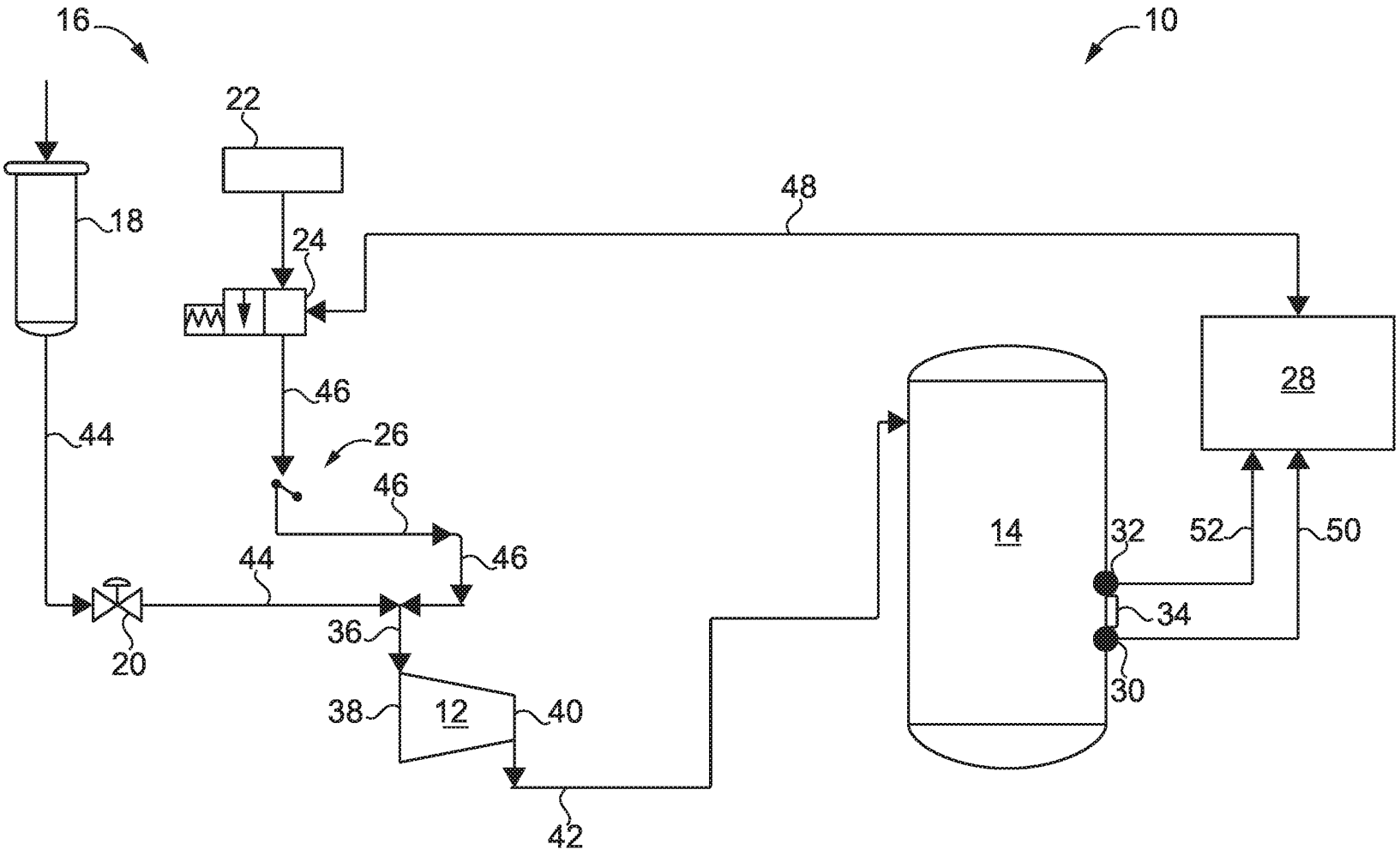
10
16
18
22
24
26
28
12
14
20
30
32
34
36
38
40
42
44
46
48
50
52

COMPRESSOR SYSTEM AND SYSTEM FOR MAINTAINING A DESIRED OIL LEVEL

TECHNICAL FIELD

The present application generally relates to compressor systems and more particularly, but not exclusively, to compressor systems with systems for maintaining a desired oil level.

BACKGROUND

Compressor systems remain an area of interest. Some existing systems have various shortcomings, drawbacks and disadvantages relative to certain applications. For example, in some compressor systems, a low oil level in a primary oil reservoir or gas/oil separator tank requires a time and labor intensive refilling of oil, e.g., after losing some oil, and results in wasted energy. Accordingly, there remains a need for further contributions in this area of technology.

SUMMARY

One embodiment of the present invention is a unique compressor system. Another embodiment is a unique system for maintaining a desired oil level in a compressor system gas/oil separator tank. Other embodiments include apparatuses, systems, devices, hardware, methods, and combinations for compressor systems and compressor system gas/oil separator tank oil level maintenance. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein:

FIG. 1 schematically illustrates some aspects of a non-limiting example of a compressor system in accordance with an embodiment of the present invention.

DETAILED DESCRIPTION OF THE ILLUSTRATIVE EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, some aspects of a non-limiting example of a compressor system 10 are schematically illustrated in accordance with an embodiment of the present invention. Compressor system 10 includes a compressor 12, a gas/oil separator tank 14, a system 16 for maintaining an oil level in gas/oil separator tank 14, a filter 18, and a control valve 20. System 16 for maintaining an oil level is constructed to maintain a desirable oil level in gas/oil separator tank 14, e.g., maintaining the oil level above a predetermined low oil level in some embodiments, and maintaining the oil level between the low oil level and a maximum or maximum desired oil level in other embodiments. System 16 includes a supplemental oil reservoir 22, a valve 24, a non-return valve 26, a controller 28, a low oil level sensor 30, and a maximum oil level sensor 32. In some embodiments, gas/oil separator tank 14 may include a sight glass 34 for manually checking the level of oil in gas/oil separator tank 14.

At various points during the operation of an oil flooded or oil injected compressor, the oil level in the pressurized primary oil tank, becomes low. This may result in starving the machine of oil, which may only be discovered when the machine trips out due to high temperature resulting from no or insufficient oil. The oil starvation results in degradation of compressor performance over time, and in some cases, the compressor rotors become damaged. Thus, it is desirable to add oil to the compressor system to maintain a desirable oil level. Oil could be added by manually shutting the compressor system down, blowing down or depressurizing the oil tank, and adding oil to top-up the primary oil reservoir, e.g., gas/oil separator tank 14. The manual top-up is for the purpose of bringing the oil level in the primary oil reservoir to a desired level. The manual top-up requires manual intervention, is time intensive, and is inefficient. For example, the blowdown of the primary oil reservoir wastes the energy of the compressed air or other gas stored therein, and startup energy is also a waste of energy, as it is not usable to the customer, i.e., the owner/user/operator of the compressor system.

System 16, e.g., supplemental oil reservoir 22, valve 24 and controller 28, are constructed to maintain a desired oil level in the gas/oil separator tank 14 without human intervention, i.e., without a manual top-up, e.g., based on input signals received from low oil level sensor 30 and maximum oil level sensor 32. In some embodiments, low oil level sensor 30 and maximum oil level sensor 32 may be considered part of a single oil level sensor that indicates both low oil level and maximum oil level conditions. With system 16, no machine shutdown or depressurizing of the system 10 or its components is required. Machine performance is more consistent due to fail safe oil level maintenance in comparison to manual top-up. For example, gas/oil separator tank 14 is topped-up using oil from supplemental oil reservoir 22, which is not pressurized, and is thus readily filled by a technician, e.g., on a periodic basis, or when the oil level in supplemental oil reservoir 22 becomes low, e.g., as indicated by a supplemental oil reservoir low oil level indicator or sensor. The auto top-up described herein may eliminate the need for regular machine visits with manual intervention for top-up, and allows the oil level control in gas/oil separator tank 14 to be more easily and precisely maintained.

In one form, compressor 12 is an oil-injected or oil-flooded rotary screw compressor operative to compress a gas, for example, air. In other embodiments, compressor 12 may take other forms. Gas is supplied to compressor 12 via an inlet line 36, e.g., a pipe, conduit, cast passage or the like. Compressor 12 includes a suction side 38 and a discharge side 40. Suction side 38 is the inlet side of compressor 12, and operates at a low pressure referred to herein as a suction pressure, e.g., a pressure below that of ambient and/or atmospheric pressure. The gas is supplied to suction side 38 of compressor 12. Suction side 38 is operative to receive the gas and the oil into compressor 12. In various embodiments, the oil may be added directly to compressor 12, e.g., injected into suction side 38 or another location, or may be added upstream of compressor 12, e.g., added to or injected into inlet line 36 or another location.

Compressor 12 is operative to compress the gas using oil received from gas/oil separator tank 14 via an oil return line (not shown). The oil serves multiple functions during the compression of the gas by compressor 12, including sealing, e.g., between compressor rotors and between the rotors and housing. Other functions include lubrication of compressor 12, e.g., of the rotors, and functioning as a heat sink to remove heat from compressor 12 and from the gas compressed by compressor 12. Discharge side 40 is operative to discharge the compressed gas and the oil from compressor 12. The gas and oil is discharged from compressor 12 out of discharge side 40, and is supplied via a discharge line 42 to gas/oil separator tank 14. Compressor system 10 may also include a gas/oil separator element and/or system (not shown), e.g., which may or may not be disposed in a tank such as gas/oil separator tank 14. The gas/oil separator element and/or system may be constructed to separate the gas and oil, wherein the gas is supplied to a downstream process, e.g., a customer process, and wherein the oil is returned to compressor 12 for re-use in compressing gas. In some embodiments, gas/oil separator tank 14 is a tank that holds oil received from a gas/oil separator, and does not include a gas/oil separator therein, but rather, receives oil from a separate gas/oil separator. In some embodiments, compressor system 10 may also include an oil cooler or radiator (not shown) constructed to transfer heat from the oil discharged by compressor 12, prior to the oil being returned to compressor 12, which, depending on the embodiment, may or may not be a part of gas/oil separator tank 14.

Gas/oil separator tank 14 is in fluid communication with discharge side 40 of compressor 12 via discharge line 42. Gas/oil separator tank 14 is operative to separate the oil from the compressed gas and store the separated oil for subsequent return to and use by compressor 12. In one form, gas/oil separator tank 14 is maintained at a high pressure, e.g., compressor 12 discharge pressure. In other embodiments, gas/oil separator tank 14 may be maintained at an intermediate pressure, e.g., above the low pressure associated with suction side 38, but below discharge pressure at discharge side 40.

Filter 18 is in fluid communication with suction side 38 of compressor 12 via a gas supply line 44. Filter 18 is operative to filter the gas received into suction side 38 of compressor 12 for compression. Control valve 20 is in fluid communication with suction side 38 of compressor 12. Control valve 20 is operative to control the pressure, i.e., the amount of suction pressure, at suction side 38 of compressor 12. Gas is supplied from filter 18 and control valve 20 to inlet line 36 via gas supply line 44.

Supplemental oil reservoir 22 is in fluid communication with suction side 38 of compressor 12 via a supplemental oil supply line 46. Supplemental oil supply line 46 is in fluid communication with suction side 38 of compressor 12 via inlet line 36. Supplemental oil reservoir 22 is operative to supply oil to compressor 12, and hence gas/oil separator tank 14, e.g., when a low oil level is detected in gas/oil separator tank 14. Valve 24 is in fluid communication with both supplemental oil reservoir 22 and with suction side 38 of compressor 12. Valve 24 is fluidly disposed between supplemental oil reservoir 22 and suction side 38. Valve 24 is operative to, when opened, expose supplemental oil reservoir 22 to the suction pressure of suction side 38, and draw oil from supplemental oil reservoir 22 by suction through supplemental oil supply line 46 and inlet line 36 into suction side 38 of the compressor 12 for use in compressing the gas. In one form, valve 24 is a solenoid operated valve. In a particular form, valve 24 is a solenoid operated directional control valve. In other embodiments, valve 24 may be another type of valve. Non-return valve 26 is fluidly coupled to valve 24 in series. Non-return valve 26 is fluidly disposed between valve 24 and suction side 38 of compressor 12. In some embodiments non-return valve 26 and solenoid valve 24 can be combined into a single body. Non-return valve 26 is operative to prevent reverse flow into valve 24 via supplemental oil supply line 46. In one form, non-return valve 26 is a check valve. In other embodiments, non-return valve 26 may take other forms.

Controller 28 is communicatively coupled to valve 24 via a communication link 48. Controller 28 is operative to execute program instructions to send a signal to valve 24 to open valve 24, e.g., responsive to an indication of a low oil level in gas/oil separator tank 14. This exposes supplemental oil reservoir 22 to the suction pressure of suction side 38 of compressor 12, and draws oil from the supplemental oil reservoir 22 into suction side 38 of the compressor 12 using the suction pressure. After compressing the oil with the gas, compressor 12 is operative to discharge the oil received from supplemental oil reservoir 22 into gas/oil separator tank 14 (after being separated from the gas), which increases the oil level in gas/oil separator tank 14.

Low oil level sensor 30 is disposed on gas/oil separator tank 14. Low oil level sensor 30 is communicatively coupled to controller 28 via a communications link 50, which may be a wired, wireless, optical or other type of communication link. Low oil level sensor 30 is operative to sense when a low oil level has been reached in gas/oil separator tank 14. Low oil level sensor 30 is operative to, responsive to the low oil level being reached, send a low oil level signal to controller 28 indicative of the low oil level being reached. Controller 28 is operative to direct valve 24 to open responsive to receiving the low oil level signal from low oil level sensor 30 indicating that the oil level is low, i.e., that the low oil level has been reached.

Maximum oil level sensor 32 is disposed on gas/oil separator tank 14. Maximum oil level sensor 32 is communicatively coupled to controller 28 via a communication link 52, which may be a wired, wireless, optical or other type of communication link. Maximum oil level sensor 32 is operative to sense when an oil level in gas/oil separator tank 14 has reached a maximum desired oil level. Maximum oil level sensor 32 is operative to send a maximum oil level signal to the controller 28 indicative of the maximum desired oil level being reached. Controller 28 is operative to close valve 24 responsive to receiving the maximum oil level signal from maximum oil level sensor 32 indicating that the oil level in gas/oil separator tank 14 has reached the maximum desired oil level.

During operation, the incoming gas is filtered by filter 18, and passes through control valve 20, through gas supply line 44, then through inlet line 36 and into suction side 38 of compressor 12. Oil is supplied to compressor 12, e.g., with the gas or directly injected into compressor 12. Compressor 12 then compresses the gas, using the oil as a sealant, lubricant and heat removal means, and discharges the gas at a higher pressure, along with the oil, via discharge side 40. The gas and oil are then discharged into discharge line 42, and supplied to gas/oil separator tank 14. The oil and gas are separated in gas/oil separator tank 14, and the gas is discharged from gas/oil separator tank 14, whereas the oil collects in gas/oil separator tank 14. In some embodiments, the gas and oil may be supplied to a separate gas/oil separator prior to being supplied to gas/oil separator tank 14. The oil is returned to compressor 12 by a return line (not shown). During operation, some of the oil is lost, e.g., due to gas/oil separation inefficiency or losses, and the oil level in gas/oil separator tank 14 gradually drops.

When the oil level reaches a low level, e.g., as determined by the position of low oil level sensor 30 on gas/oil separator tank 14, the settings of low oil level sensor 30 or one or more other parameters, low oil level sensor 30 generates a low oil level signal, which is supplied to controller 28 via communication link 50. Responsive to the low oil level signal, controller 28 directs valve 24 to open, e.g., by sending a signal to valve 24, or by terminating a signal previously sent to valve 24. Once valve 24 is opened, oil is drawn by the low pressure of suction side 38 from supplemental oil reservoir 22, through valve 24 and non-return valve 26, supplemental oil supply line 46 and inlet line 36 into suction side 38 of compressor 12, where it is used in compressing the incoming gas. The gas, along with any oil supplied by gas/oil separator tank 14 and the supplemental oil supplied by supplemental oil reservoir 22 is discharged from compressor 12 into gas/oil separator tank 14 via discharge line 42.

The gas is discharged from gas/oil separator tank 14 after gas/oil separation, and the oil, i.e., the oil supplied by gas/oil separator tank 14, along with the oil supplied by supplemental oil reservoir 22, collects at the bottom of gas/oil separator tank 14, raising the level of the oil in gas/oil separator tank 14 by the amount of oil provided by supplemental oil reservoir 22 (minus any losses stemming from gas/oil separation inefficiency). After a period of operation, the oil level in gas/oil separator tank 14 is topped-up, i.e., when the oil level in gas/oil separator tank 14 rises to a maximum oil level, i.e., a maximum desired oil level, which is a preselected upper oil level limit. The oil is topped-up during the operation of compressor 12, without requiring a shutdown of compressor 12, and without requiring a blowdown of gas/oil separator tank 14. The upper oil level limit is, for example, governed by the position of maximum oil level sensor 32 on gas/oil separator tank 14, the settings of maximum oil level sensor 32 or one or more other parameters.

When the upper oil level limit is reached, maximum oil level sensor 32 generates a maximum oil level signal, which is supplied to controller 28 via communication link 52. Responsive to the maximum oil level signal, controller 28 directs valve 24 to close, e.g., by sending a close signal to valve 24, or by terminating a previously sent or continuous 'open' signal. When valve 24 is closed, oil is not drawn from supplemental oil reservoir 22 into suction side 38. After the oil level becomes low again, the process repeats, beginning with the low oil level signal being sent from low oil level sensor 30.

Embodiments of the present invention include a compressor system, comprising: a compressor having a suction side and a discharge side, wherein the compressor is operative to compress a gas using oil, wherein the suction side operates at a suction pressure and is operative to receive a the gas and the oil into the compressor; and wherein the discharge side is operative to discharge the compressed gas and the oil; a gas/oil separator tank in fluid communication with the discharge side of the compressor, wherein the gas/oil separator tank is operative to store oil separated from the compressed gas for subsequent use by the compressor; a supplemental oil reservoir in fluid communication with the suction side; and a valve in fluid communication with both the supplemental oil reservoir and with the suction side of the compressor and fluidly disposed between the supplemental reservoir and the suction side, wherein the valve is operative to, when opened, expose the supplemental oil reservoir to the suction pressure of the suction side, and draw oil from the supplemental oil reservoir by suction into the suction side of the compressor.

In a refinement, the compressor system further comprises a controller communicatively coupled to the valve, the controller being operative to execute program instructions to send a signal to open the valve and expose the supplemental oil reservoir to the suction pressure of the compressor suction side, and draw oil from the supplemental oil reservoir into the suction side of the compressor using the suction pressure, wherein the compressor discharges the oil from the supplemental oil reservoir into the gas/oil separator tank and increases the oil level in the gas/oil separator tank.

In another refinement, the compressor system further comprises an oil level sensor disposed on the gas/oil separator tank and communicatively coupled to the controller, wherein the oil level sensor is operative to sense when a low oil level has been reached in the gas/oil separator tank, and is operative to, responsive to the low oil level being reached, send a low oil level signal to the controller indicative of the low oil level being reached; and wherein the controller is operative direct the valve to open responsive to receiving the low oil level signal from the oil level sensor indicating that the oil level has been reached.

In yet another refinement, the compressor system further comprises an oil level sensor disposed on the gas/oil separator tank and communicatively coupled to the controller, wherein the oil level sensor is operative to sense when an oil level in the gas/oil separator tank has reached a maximum desired oil level, and is operative to, responsive to the maximum desired oil level being reached, send a maximum oil level signal to the controller indicative of the maximum desired oil level being reached; wherein the controller is operative to direct the valve to close responsive to receiving the maximum oil level signal from the oil level sensor indicating that the oil level in the gas/oil separator tank has reached a maximum desired oil level.

In still another refinement, the valve is a solenoid operated directional control valve.

In yet still another refinement, the compressor system further comprises a non-return valve fluidly coupled to the valve in series, and fluidly disposed between the valve and the suction side of the compressor.

In a further refinement, the non-return valve is a check valve.

In a yet further refinement, the compressor system further comprises a filter in fluid communication with the suction side of the compressor, wherein the filter is operative to filter gas received into the suction side of the compressor.

In a still further refinement, the compressor system further comprises a control valve in fluid communication with the suction side of the compressor, wherein the control valve is operative to control the suction pressure.

In a yet still further refinement, the supplemental oil reservoir, valve and controller are constructed to maintain a desired oil level in the gas/oil separator tank without human intervention.

Embodiments of the present invention include a system for maintaining a desired oil level in a compressor system gas/oil separator tank, the compressor system including a compressor, comprising: a supplemental oil reservoir in fluid communication with a suction side of the compressor of the compressor system; and a valve in fluid communication with both the supplemental reservoir and with the suction side of the compressor and fluidly disposed between the supplemental reservoir and the suction side, wherein the valve is operative to, when opened, expose the supplemental oil reservoir to suction pressure of the suction side, and to draw oil from the supplemental oil reservoir by suction into the suction side of the compressor.

In a refinement, the system further comprises a controller communicatively coupled to the valve, the controller being operative to execute program instructions to send a signal to open the valve and expose the supplemental oil reservoir to the suction pressure of the compressor suction side, and draw oil from the supplemental oil reservoir into the suction side of the compressor using the suction pressure, wherein the compressor discharges the oil from the supplemental oil reservoir into the gas/oil separator tank and increases the oil level in the gas/oil separator tank.

In another refinement, the oil reservoir, valve and controller maintain a desired oil level in the gas/oil separator tank without human intervention.

In yet another refinement, the system further comprises an oil level sensor disposed on the gas/oil separator tank and communicatively coupled to the controller, wherein the oil level sensor is operative to sense when a low oil level has been reached in the gas/oil separator tank, and is operative to, responsive to the low oil level being reached, send a low oil level signal to the controller indicative of the low oil level being reached; and wherein the controller is operative to direct the valve to open responsive to receiving the low oil level signal from the oil level sensor indicating that the oil level is low.

In still another refinement, the system further comprises an oil level sensor disposed on the gas/oil separator tank and communicatively coupled to the controller, wherein the oil level sensor is operative to sense when an oil level in the gas/oil separator tank has reached a maximum desired oil level, and is operative to, responsive to the maximum desired oil level being reached, send a maximum oil level signal to the controller indicative of the maximum desired oil level being reached; wherein the controller is operative to direct the valve to close responsive to receiving the maximum oil level signal from the oil level sensor indicating that the oil level in the gas/oil separator tank has reached a maximum desired oil level.

In yet still another refinement, the valve is a solenoid operated directional control valve.

In a further refinement, the system further comprises a non-return valve fluidly coupled to the valve in series, and fluidly disposed between the valve and the suction side of the compressor.

In a yet further refinement, the non-return valve is a check valve.

In a still further refinement, the compressor system includes a filter in fluid communication with the suction side of the compressor, the filter being operative to filter gas received into the suction side of the compressor; and wherein the supplemental oil reservoir and the valve are disposed in parallel to the filter.

In a yet still further refinement, the compressor system includes a control valve in fluid communication with the suction side of the compressor; wherein the control valve is operative to control the suction pressure of the suction side of the compressor; and wherein the supplemental oil reservoir and the valve are disposed in parallel to the control valve.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system, comprising:

a compressor having a suction side and a discharge side, wherein the compressor is operative to compress a gas using oil, wherein the suction side operates at a suction pressure and is operative to receive the gas and the oil into the compressor; and wherein the discharge side is operative to discharge the compressed gas and the oil;

a gas/oil separator tank in fluid communication with the discharge side of the compressor, wherein the gas/oil separator tank is operative to store oil separated from the compressed gas for subsequent use by the compressor;

a supplemental oil reservoir in fluid communication with the suction side; the supplemental oil reservoir isolated from the compressed gas discharged from the compressor such that the compressed gas does not pass into the supplemental oil reservoir;

a valve in fluid communication with both the supplemental oil reservoir and with the suction side of the compressor and fluidly disposed between the supplemental reservoir and the suction side, wherein the valve is operative to, when opened, expose the supplemental oil reservoir to the suction pressure of the suction side, and draw oil from the supplemental oil reservoir by suction into the suction side of the compressor a controller communicatively coupled to the valve, the controller being operative to execute a program instructions to send a signal to open the valve and expose the supplemental oil reservoir to the suction pressure of the compressor suction side, and draw oil from the supplemental oil reservoir into the suction side of the compressor using the suction pressure, wherein the compressor discharges the oil from the supplemental oil reservoir into the gas/oil separator tank and increases the oil level in the gas/oil separator tank; and an oil level sensor disposed on the gas/oil separator tank and communicatively coupled to the controller;

wherein the oil level sensor is operative to sense when a low oil level has been reached in the gas/oil separator tank, and is operative to, responsive to the low oil level being reached, send a low oil level signal to the controller indicative of the low oil level being reached; and wherein the controller is operative to direct the valve to open responsive to receiving the low oil level signal from the oil level sensor indicating that the low oil level has been reached.

2. The compressor system of claim 1, further comprising an oil level sensor disposed on the gas/oil separator tank and communicatively coupled to the controller, wherein the oil level sensor is operative to sense when an oil level in the gas/oil separator tank has reached a maximum desired oil level, and is operative to, responsive to the maximum desired oil level being reached, send a maximum oil level signal to the controller indicative of the maximum desired oil level being reached; wherein the controller is operative to direct the valve to close responsive to receiving the maximum oil level signal from the oil level sensor indicating that the oil level in the gas/oil separator tank has reached a maximum desired oil level.

3. The compressor system of claim 1, wherein the valve is a solenoid operated directional control valve.

4. The compressor system of claim 1, further comprising a non-return valve fluidly coupled to the valve in series, and fluidly disposed between the valve and the suction side of the compressor.

5. The compressor system of claim 4, wherein the non-return valve is a check valve.

6. The compressor system of claim 1, further comprising a filter in fluid communication with the suction side of the compressor, wherein the filter is operative to filter gas received into the suction side of the compressor.

7. The compressor system of claim 1, further comprising a control valve in fluid communication with the suction side of the compressor, wherein the control valve is operative to control the suction pressure.

8. The compressor system of claim 1, wherein the supplemental oil reservoir, valve and controller are constructed to maintain a desired oil level in the gas/oil separator tank without human intervention.

9. A system for maintaining a desired oil level in a compressor system gas/oil separator tank, the compressor system including a compressor, comprising:

a supplemental oil reservoir isolated from a compressed air discharged from the compressor such that compressed air does not pass into the supplemental oil reservoir, the supplemental oil reservoir in fluid communication with a suction side of the compressor of the compressor system; and a valve in fluid communication with both the supplemental reservoir and with the suction side of the compressor and fluidly disposed between the supplemental reservoir and the suction side, wherein the valve is operative to, when opened, expose the supplemental oil reservoir to suction pressure of the suction side, and to draw oil from the supplemental oil reservoir by suction into the suction side of the compressor.

10. The system of claim 9, further comprising:

a controller communicatively coupled to the valve, the controller being operative to execute program instructions to send a signal to open the valve and expose the supplemental oil reservoir to the suction pressure of the compressor suction side, and draw oil from the supplemental oil reservoir into the suction side of the compressor using the suction pressure, wherein the compressor discharges the oil from the supplemental oil reservoir into the gas/oil separator tank and increases the oil level in the gas/oil separator tank.

11. The system of claim 10, wherein the supplemental oil reservoir, the valve and the controller maintain a desired oil level in the gas/oil separator tank without human intervention.

12. The system of claim 10, further comprising an oil level sensor disposed on the gas/oil separator tank and communicatively coupled to the controller, wherein the oil level sensor is operative to sense when a low oil level has been reached in the gas/oil separator tank, and is operative to, responsive to the low oil level being reached, send a low oil level signal to the controller indicative of the low oil level being reached; and wherein the controller is operative to direct the valve to open responsive to receiving the low oil level signal from the oil level sensor indicating that the oil level is low.

13. The system of claim 10, further comprising an oil level sensor disposed on the gas/oil separator tank and communicatively coupled to the controller, wherein the oil level sensor is operative to sense when an oil level in the gas/oil separator tank has reached a maximum desired oil level, and is operative to, responsive to the maximum desired oil level being reached, send a maximum oil level signal to the controller indicative of the maximum desired oil level being reached; wherein the controller is operative to direct the valve to close responsive to receiving the maximum oil level signal from the oil level sensor indicating that the maximum desired oil level in the gas/oil separator tank has reached a maximum desired oil level.

14. The system of claim 9, wherein the valve is a solenoid operated directional control valve.

15. The system of claim 9, further comprising a non-return valve fluidly coupled to the valve in series, and fluidly disposed between the valve and the suction side of the compressor.

16. The system of claim 15, wherein the non-return valve is a check valve.

17. The system of claim 9, wherein the compressor system includes a filter in fluid communication with the suction side of the compressor, the filter being operative to filter gas received into the suction side of the compressor; and wherein the supplemental oil reservoir and the valve are disposed in parallel to the filter.

18. The system of claim 9, wherein the compressor system includes a control valve in fluid communication with the suction side of the compressor; wherein the control valve is operative to control the suction pressure of the suction side of the compressor; and wherein the supplemental oil reservoir and the valve are disposed in parallel to the control valve.

* * * * *